United States Patent [19]

Mitter

[11] 4,444,105

[45] Apr. 24, 1984

[54] APPARATUS FOR APPLYING INK TO NAPPED FABRICS OR THE LIKE

[76] Inventor: Mathias Mitter, Falkenstrasse 57, D-4815 Schloss Holte, Fed. Rep. of Germany

[21] Appl. No.: 418,414

[22] Filed: Sep. 15, 1982

[30] Foreign Application Priority Data

Sep. 23, 1981 [DE] Fed. Rep. of Germany ..... 3137763

[51] Int. Cl.[3] ..... B41L 13/00; B05C 5/00

[52] U.S. Cl. ..... 101/120; 68/202; 118/262

[58] Field of Search ..... 101/116–120; 68/202; 118/262

[56] References Cited

U.S. PATENT DOCUMENTS

| | | | |
|---|---|---|---|
| 3,834,307 | 9/1974 | Zimmer | 101/119 |
| 3,965,816 | 6/1976 | Mitter | 101/120 |
| 3,987,724 | 10/1976 | Zimmer | 101/119 |
| 3,995,551 | 12/1976 | Mitter | 101/118 |
| 4,138,943 | 2/1979 | Mitter | 101/119 |
| 4,299,164 | 11/1981 | Jonkers | 101/119 X |

FOREIGN PATENT DOCUMENTS

| | | | |
|---|---|---|---|
| 1913175 | 11/1975 | Fed. Rep. of Germany | 101/119 |
| 197809 | 9/1978 | United Kingdom | 101/119 |

*Primary Examiner*—E. H. Eickholt

*Attorney, Agent, or Firm*—Peter K. Kontler

[57] ABSTRACT

A screen printing apparatus wherein a mobile screen is located at a variable distance above the stock and the pool of liquid which is admitted into the interior of the screen flows through the open pores to descend, exclusively by gravity, onto the surface of the stock. Various special effects can be achieved by changing the distance between the screen and the stock, by changing the speed of the screen, by appropriate distribution of pores in the screen, by subdivision of the pool into two or more separate pools, by placing two or more screens one behind the other, as considered in the direction of stock feed, by inserting a squeegee into or by removing the squeegee from the interior of the screen, by oscillating the liquid feeding pipe or pipes and/or the squeegee, and/or by a combination of such undertakings.

30 Claims, 7 Drawing Figures

APPARATUS FOR APPLYING INK TO NAPPED FABRICS OR THE LIKE

BACKGROUND OF THE INVENTION

The present invention relates to screen printing apparatus in general, and more particularly to improvements in screen printing apparatus wherein the screen is a rotary body, such as a cylinder.

It is already known to provide a screen printing apparatus with a cylindrical screen whose interior receives the liquid medium (hereinafter called ink) to be applied to a moving stock, such as a thin web of textile material, a carpet or the like. The ink accumulates in the lower portion of the interior of the rotating screen and forms therein a pool whose contents drip through the pores of the screen to descend onto the stock therebelow. The screen need not be a cylinder; it can also constitute a band, a stencil, a stencil band or the like. Such apparatus are used in screen printing machines for a variety of purposes, e.g., to impart to the stock a pattern consisting of a single color or of several different colors, or to simply color the stock if the pores of the screen do not represent an image.

In accordance with a normal screen printing technique, ink which is to be applied to the stock is spread over the stock by resorting to squeegees in the form of rollers, slotted or unslotted doctor blades or the like. Such squeegees cause ink to penetrate through the pores of the screen and to form an image on the stock therebelow. The application of patterns to webs of fabric or the like is desirable and advantageous in many instances. However, if the apparatus is to cover large or very large areas, e.g., in connection with the treatment of various forms of carpeting, it is not always desirable or advantageous to repeat the same pattern all over again because it is difficult to accurately match repetitive patterns in the regions of the so-called seams. Accurate matching is particularly difficult if the area to be covered is large or extremely large. Therefore, the trend in the industry is to effect a so-called dispersion of the patterns.

It is further known to resort to cylindrical screens in connection with the so-called uni-printing. To this end, the pores are distributed uniformly in the entire screen to thus ensure that the application of ink to the stock will be uniform. This is often desirable or necessary when the applied medium is a chemical substance. As a rule, the just discussed technique should result in uniform coloring or imprinting of the entire stock which can thereafter be provided with one or more patterns in the course of a secondary treatment, e.g., by different structuring of the substrate, by resort to various light and shadow effects and/or others.

German Auslegeschrift No. 19 13 175 discloses the possibility of installing the screen at a certain distance from the stock. The interior of the cylindrical screen contains a pressure generating and backup squeegee which is immediately adjacent to a counterpressure generating device constituting a second squeegee. The screen is installed at a level above the path of the stock and the apparatus operates in such a way that the squeegees together constitute a weir the upper part of which is located in the interior of the cylindrical screen and the lower part of which is located at a level below the screen. Thus, the weir serves to accumulate ink first in the interior of the screen, and such ink descends by gravity and flows along the lower part of the weir, namely, along the second squeegee, to form a more or less uniform stream extending along the full length of the cylindrical screen. A drawback of such apparatus is that the ink cannot descend by gravity directly onto the stock; instead, the descending ink is converted into a shallow stream on its way from the interior of the screen toward the path of the stock. Therefore, if the pores of the screen form one or more patterns, such pattern or patterns disappear when the ink issuing from the pores is converted into a stream before it reaches the stock. In other words, the entire pattern disappears and the stock is merely coated with a more or less uniform layer of ink. Such equalization of the outflowing mass of ink is evidently undesirable if the pores of the screen form an image or pattern since the utilization of a patterned screen or stencil then serves no useful purpose. Thus, the situation is the same as if a screen whose pores form one or more patterns were replaced with a screen which is formed with uniformly distributed pores.

Another drawback of such apparatus is that the first squeegee removes ink from the screen so that each increment of the screen is clean when it begins a fresh revolution. This is not conducive to the formation of desirable patterns on the stock.

OBJECTS AND SUMMARY OF THE INVENTION

An object of the invention is to provide a novel and improved screen printing apparatus wherein the screen need not contact the stock but the apparatus is nevertheless capable of providing the stock with a variety of patterns.

Another object of the invention is to provide an apparatus of the above outlined character wherein the characteristics of the pattern which is determined by the distribution of pores in the screen can be varied and influenced in a surprisingly simple and inexpensive way.

A further object of the invention is to provide the apparatus with novel and improved means for regulating or varying the characteristics of the pattern which is applied to the stock, e.g., to a napped fabric or the like.

An additional object of the invention is to provide a screen printing apparatus wherein the stock can be provided with a desired pattern by ink which descends onto the stock by gravity alone.

Another object of the invention is to provide a novel and improved method of applying to the stock a desired pattern without establishing a direct contact between the screen and the stock.

A further object of the invention is to provide an apparatus which can be used to apply to the stock a pattern in one color or in a plurality of different colors in a single operation.

Another object of the invention is to provide an apparatus which can be utilized for the application of a wide variety of liquid media including paints, chemicals, varnishes, lacquers and/or others.

A further object of the invention is to provide novel and improved means for establishing and maintaining a pool of liquid in the interior of a rotary cylindrical or analogous screen in a screen printing apparatus.

The invention is embodied in a screen printing apparatus (of the type disclosed, for example, in U.S. Pat. Nos. 3,565,002, 3,565,003 and 3,718,086) which comprises a circulating or otherwise moving hollow porous screen (e.g., a cylindrical screen which rotates about a horizontal axis); a printer's blanket, a stationary base, a rotary cylindrical drum or other suitable means defining for the stock to be treated (e.g., a carpet) a path which is disposed at a level below and is spaced apart from the screen; and means for feeding into the interior of the screen at least one liquid medium which forms therein a pool and passes through the pores of the screen to descend, solely or practically exclusively by gravity, onto the stock in the aforementioned path. The apparatus further comprises carrier means for supporting the screen at a selected distance above the path, and such carrier means preferably includes means for infinitely varying the distance between the screen and the path.

The apparatus preferably further comprises pressure-free applicator means (e.g., a rigid, elastic and/or slotted doctor blade or an analogous squeegee) which is associated with and is preferably disposed in the interior of the screen to cooperate with the latter so as to effect the passage of liquid medium through the pores of the screen. Such pores can be uniformly distributed over the entire screen, or they may form one or more patterns or images which are to be transferred onto the stock.

The aforementioned carrier means can include a portion which is installed in the interior of the screen and can serve to support the feeding means. Such portion may extend lengthwise of the screen and may consist of several sections which are spaced apart from one another, as considered in the longitudinal direction of the screen. The carrier means can be stationary and is designed to provide room for accumulation of the pool, consisting of one or more liquid media, in the lower portion of the interior of the screen. The aforementioned applicator means can be supported by the carrier means in the interior of the screen; in fact, a portion of the carrier means can constitute such applicator means, and the applicator means can define an elongated channel for accumulation of the pool therein. The ends of the channel can be closed by end walls which are mounted on the carrier means. The channel is preferably horizontal and is disposed in the lower part of the interior of the screen, e.g., between the five and seven o'clock positions of a cylindrical screen.

The apparatus can comprise at least one partition which is disposed in and divides the interior of the screen into several compartments each of which can receive a different liquid medium. The partition or partitions can constitute the aforementioned applicator or applicators and may be reciprocated by a vibrator or the like back and forth in the longitudinal direction of the screen. The feeding means preferably extends lengthwise of the screen and has several outlet openings spaced apart from one another, as considered in the longitudinal direction of the screen. The partition or partitions can be disposed between the outlet openings of the feeding means so that each compartment in the interior of the screen can receive liquid medium from a single outlet opening or from a group of outlet openings. The feeding means can comprise at least one pipe or an analogous liquid feeding element which extends into and lengthwise of the screen. In fact, the feeding means can constitute the aforementioned carrier means for the screen and then maintains the screen at a selected distance from the path. The feeding means can be oscillated with or relative to the carrier means for the screen. For example, if the screen is mounted on its carrier means and such carrier means also supports the feeding means, the feeding means can be vibrated through the medium of the carrier means. The partition or partitions in the interior of the screen can share the oscillatory movements of the feeding means, namely, movements in the longitudinal direction of the screen. Each pipe or an analogous feeding element of the feeding means can receive liquid medium from a common source or from a discrete source of liquid, i.e., the pool can consist of a single liquid medium or it can consist of two or more different liquid media which may but need not necessarily mix in the interior of the screen.

The apparatus preferably further comprises means for moving (e.g., rotating or circulating) the screen at any one at a preferably infinite number of different speeds. This, if necessary in combination with the admission of two or more different liquid media and/or with oscillation of the feeding means, enables the apparatus to produce a variety of different effects as regards the distribution of liquid medium or media on and in the stock.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
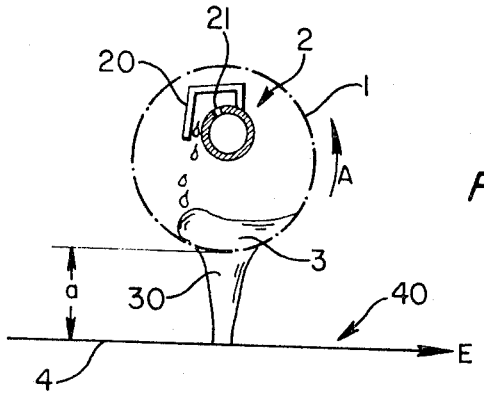
FIG. 1 is a schematic transverse sectional view of an apparatus which embodies one form of the invention.

Referring first to FIG. 1, there is shown a screen printing apparatus comprising a foraminous cylindrical screen or stencil 1 which can be constructed and assembled in a number of different ways. Such screens are also known as stencil cylinders. Reference may be had, for example, the German Pat. No. 20 26 492. The same holds true for the manner of mounting the screen in the printing apparatus. In many conventional apparatus, the screen will simply rest on the stock (such as a textile web 4 which is shown in FIG. 1); however, the screen will or can be lifted off the stock during the intervals of idleness of the apparatus. The manner of mounting the screen 1, including the manner of lifting and lowering the screen, the manner of rotating the screen and (to a certain extent) the manner of feeding ink to the screen, form no part of the present invention. Furthermore, the screen 1 need not necessarily constitute a stencil, and it can be made of textile filaments, wire, synthetic plastic material or the like.

FIG. 1 does not illustrate the mode of mounting the screen 1 in its frame and/or the means for supporting the screen. The means for feeding one or more inks or other liquid media comprises a pipe 2 which extends into the interior of the screen 1 and a portion of which is overlapped by an ink intercepting hood 20 extending in the longitudinal direction of the screen. The pipe 2 has a row of ink discharging outlet openings 21 which cause jets of ink to impinge upon the inner side of the hood 20 so that the descending droplets cannot unduly agitate a pool 3 which gathers in the lower part of the interior of the screen 1. This holds true even if the pressure of ink in the pipe 2 is quite pronounced, i.e., if the jets issuing via outlet openings 21 impinge upon the internal surface of the hood 20 with a substantial force. However, the utilization of ink feeding means which does not employ an intercepting device in the form of a hood or the like is not excluded, especially if the ink is supplied at a relatively low pressure.

A downwardly tapering wedge-like stream 30 of ink is established between the lowermost portion of the exterior of the screen 1 and the upper side or surface 40 of the flat stock 4. Such stream is replenished by ink in the pool 3; the ink flows through the pores of the screen 1 while the screen is rotated in the direction which is indicated by the arrow A and while the stock 4 advances in the direction indicated by the arrow E. The reference character a denotes the distance between the lowermost point of the screen 1 and the surface 40 of the stock 4. The surface 40 of the stock 4 can throttle the rate of flow of ink into the interior of the stock, or the ink begins to work in the interior of the stock by osmosis, diffusion or by simply flowing deeper into the interior of the stock.

As the screen 1 rotates in the direction of the arrow A, the pool 3 travels in the interior of the screen and thereby exerts a continuously varying pressure upon the internal surface of the screen. If the screen 1 is rotated at a relatively high speed, the centrifugal force of the pool 3 also contributes to the magnitude of the force acting against the inner side of the screen. This causes the ink (e.g., a more or less viscous coloring matter) to penetrate through the pores of the screen 1.

The distance a between the screen 1 and the surface 40 of the stock 4 (which advances in the direction of arrow E) can be varied infinitely. Such distance can be in the range of one or more millimeters, but it can also be increased to a multiple of such distance, e.g., to 10, 20 or 30 centimeters. The selection of the distance a depends on the desired effect upon the stock 4 (as a rule, the distance a will be selected with a view to provide the stock 4 with a predetermined pattern of coloring matter).

Figure 2:
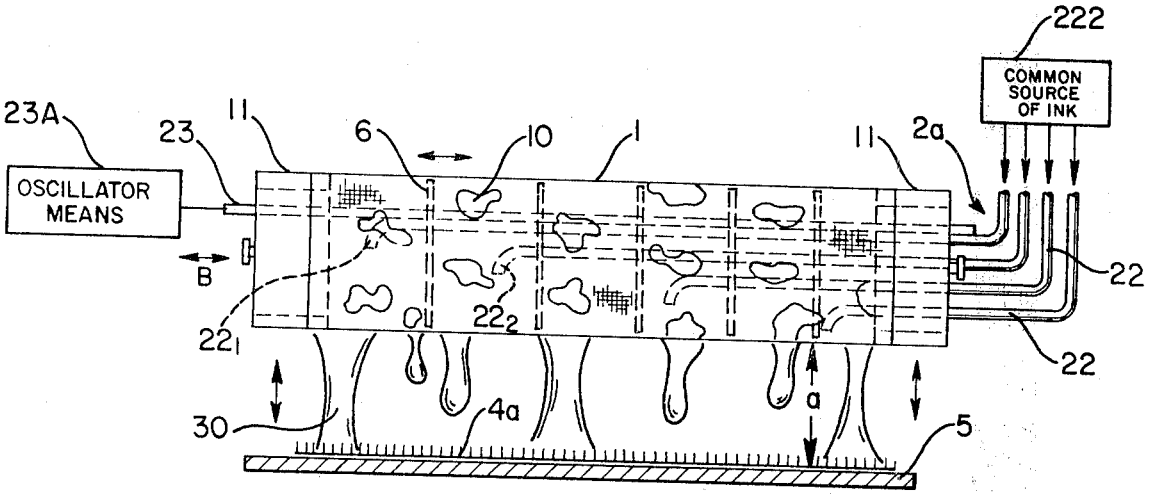
FIG. 2 is a schematic side elevational view of a somewhat modified apparatus.

FIG. 2 illustrates a second embodiment of the improved apparatus. The stock **4*a* is a carpet or an analogous napped fabric which rests on a printer's blanket 5. The distance a between the stock 4*a* and the cylindrical screen 1 is again variable at will, i.e., infinitely. The ink feeding means 2*a* of the apparatus which is shown in FIG. 2 comprises a plurality of flexible tubular elements 22 in the form of hoses each of which extends into the interior of the screen 1 to a different extent and which are supported by a carrier 23. The latter extends in parallelism with the axis of and through the entire screen 1. The end portions of the carrier 23 can be supported by the bearings for the tubular end portions 11 or sleeves of the screen 1**.

FIG. 2 shows that the pores of the screen 1 together constitute a pattern or image 10 which is transferred onto the stock **4*a* in response to rotation of the screen about its own axis and in response to simultaneous movement of the stock 4*a* toward or away from the plane of FIG. 2 (or angular and sidewise movement of the screen 1 relative to the stock). The drops or streams 30 of ink extend from the screen 1 to the nap of the stock 4*a* on the blanket 5. Under certain circumstances, the streams 30 can descend only by gravity, i.e., without resort to any special means for forcing the ink from the interior of the screen 1 and through the pores of the pattern 10 toward and onto the stock 4*a***.

The liquid media which are supplied by the hoses 22 can constitute several streams consisting of one and the same ink (see the common source 222). However, it is equally within the purview of the invention to employ each of the hoses 22 (or groups of two or more hoses) for the admission of different types of inks. In such instance, various portions or sections of the pattern 10 receive different types of ink. FIG. 2 shows four hoses 22, and each such hose can supply ink in a different color or it can supply ink of a different consistency. The discharge ends of the hoses 22 are staggered, as considered in the axial direction of the screen 1, so that (if the hoses 22 supply different types of ink) different zones of the stock **4*a* will be provided with differently colored images or patterns. For example, the discharge end $22_1$ can supply ink in a particular color. The next discharge end $22_2$ (as considered in a direction from the left to the right) can deliver a liquid substance whose color deviates from the color of ink issuing via discharge end $22_1$, e.g., a medium which produces a glossy effect. The cylindrical screen 1 can be driven at any one of a number of different speeds, and the inks issuing via discharge ends of the hoses 22 do or can merge in the interior of the screen. However, it is equally within the purview of the invention to divide the interior of the screen 1 into several compartments by insertion of transverse partitions 6 which can be mounted on the carrier 23 and serve to separate the discharge ends $22_1$, $22_2$, etc. from one another to thus reduce the likelihood of or to prevent any mixing of various inks in the interior of the screen. The partitions 6 are preferably stationary, the same as the carrier 23 and hoses 22. Such partitions are optional but their use is often desirable and highly advantageous, e.g., if the operator wishes to produce special effects by resort to differently colored inks, glossing substances and/or other media which can be applied to the stock 4*a*. It is further possible to oscillate the partitions 6 and/or the hoses 22 in the axial direction of the screen 1 (note the double-headed arrow B) if the operator wishes to achieve certain special effects. The means for oscillating the carrier 23 is shown schematically at 23A**; such oscillating means can constitute a commercially available vibrator.

Oscillatory movements of the carrier 23 can be induced and maintained in a number of different ways. Also, in lieu of being oscillated, the carrier 23 can be caused to rotate about an axis which is parallel to the axis of the screen 1 if the partitions 6 are not exactly normal to such axis. The partitions 6 then wobble as soon as the carrier 23 is set in rotary motion, and such wobbling entails a desirable agitation of the pool in the interior of the screen 1. Some scraping or agitation of ink in the screen 1 may be desirable if the ink is a highly viscous substance. Such scraping can be effected by the partitions 6 if they are oscillated lengthwise of the screen and extend into the pool in the lower portion of the interior of the screen so that they come close to or are in actual contact with the internal surface of the screen.

Figure 3:
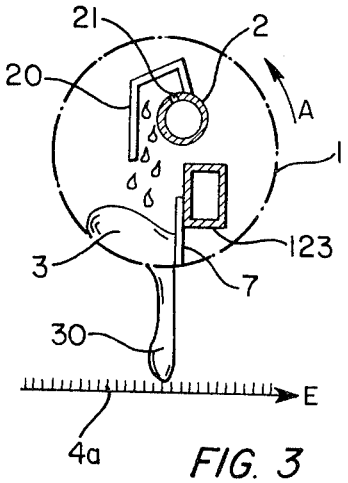
FIG. 3 is a transverse sectional view of a third apparatus.

FIG. 3 illustrates a further embodiment of the improved apparatus wherein the cylindrical screen 1 is shown schematically by a phantom-like circle. The ink feeding unit 2 in the interior of the screen 1 is analogous to that which is shown in FIG. 1, and its parts are denoted by similar reference characters. The interior of the screen 1 further accommodates a squeegee in the form of a rigid or substantially rigid doctor blade 7 mounted on an elongated holder 123 extending in parallelism with the axis of the screen 1. The stock 4*a* is assumed to be a carpet or another napped fabric. The directions of rotation of the screen 1 and of translatory movement of the stock 4*a* are respectively denoted by arrows A and E. The blade 7 can be said to constitute a wall which extends in parallelism with the axis of the screen 1 (or is located in a plane including such axis) and acts as a boundary for one side of the pool 3 of ink which gathers in the lowermost portion of the interior of the screen 1. The stream 30 descends from the pool 3 by gravity and flows through the pores of the screen 1 and toward the nap of the stock 4*a*.

Figure 4:
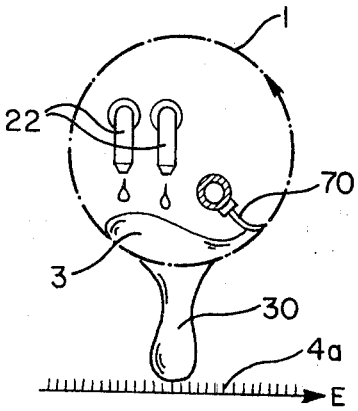
FIG. 4 is a similar transverse sectional view of a fourth apparatus.

Referring to FIG. 4, there is shown an apparatus having a cylindrical screen 1, an ink feeding unit including two hoses or pipes 22 discharging droplets of ink into a pool 3, and a flexible squeegee in the form of a doctor blade 70 made of rubber or the like and sweeping along the internal surface of the rotating screen 1 to constitute a boundary for one side of the pool 3. The main purpose of the deformable blade 70 need not be to prevent any flow of ink along the internal surface of the screen 1 but rather to limit the mass of that body of liquid which is allowed to share the angular movement of the screen 1 about its own axis. The pool 3 supplies ink which forms the stream 30 descending onto the stock 4*a*, e.g., onto a napped fabric in the form of a carpet or the like.

It is immaterial whether the cylindrical screen 1 rotates in a clockwise or in a counterclockwise direction. This is due to the fact that the external surface of the screen 1 does not come into actual contact with the stock. Free dripping of ink and/or the establishment of the stream 30 or a similar flow will take place even if the direction of rotation of the screen 1 departs from the customary direction of rotation with reference to the direction of lengthwise or other linear movement of the stock 4 or 4*a*. By way of example, the screen 1 of FIG. 4 could be driven to rotate in a clockwise direction even though the stock 4*a* advances in a direction to the right (arrow E). All that is necessary if the screen 1 rotates clockwise is to place the deformable blade 70 at the other side of the pool 3.

Figure 5:
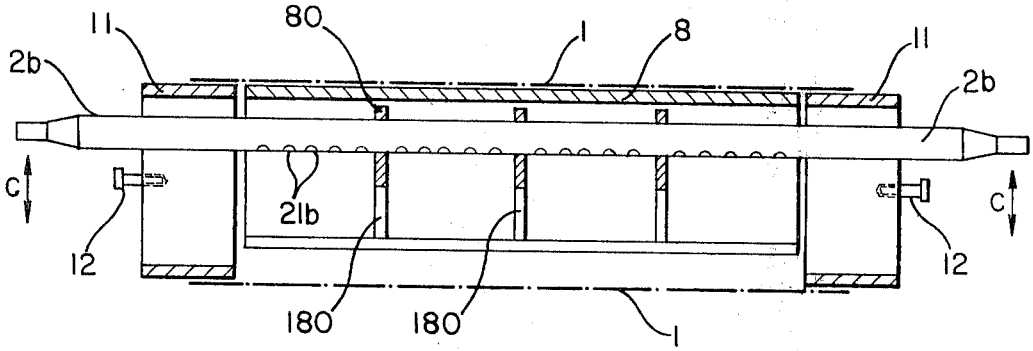
FIG. 5 is a fragmentary longitudinal vertical sectional view of a fifth apparatus.

Referring to FIG. 5, there is shown an apparatus whose screen 1 includes tubular end portions or sleves 11 flanking an elongated carrier 8 for several transverse wall members or partitions 80 whose lower portions are slotted, as at 180. The carrier 8 constitutes a portion of a pipe or shell which supports the partitions 80 in such a way that they are disposed substantially centrally of the screen 1. The slots 180 preferably diverge, as considered downwardly, i.e., the width of such slots increases in a direction toward the six o'clock position of the screen 1. The slots 180 provide room for the pool of ink in the interior of the screen 1. The carrier 8 is mounted on the ink feeding unit 2*b* which is an elongated tube extending into and in parallelism with the axis of the screen 1 and having downwardly directed outlet openings 21*b* to discharge ink into the pool in the lower part of the interior of the screen 1.

The slots 180 can be omitted if the interior of the screen 1 is to be subdivided into several discrete or substantially discrete compartments each of which receives (or some of which receive) a different type of ink.

The ink feeding unit 2*b* is adjustable in the directions indicated by a double-headed arrow C to ensure that the outlet openings 21*b* are located at an optimum distance from the pool which accumulates in the lower portion of the screen.

The reference characters 12 denote bolts or like fasteners which are used to secure the screen 1 to its frame and to the means which sets the screen in rotary motion. The bearings for the screen 1 may resemble rings which are installed in supporting heads in a manner well known from the art of screen printing machines.

Figure 6:
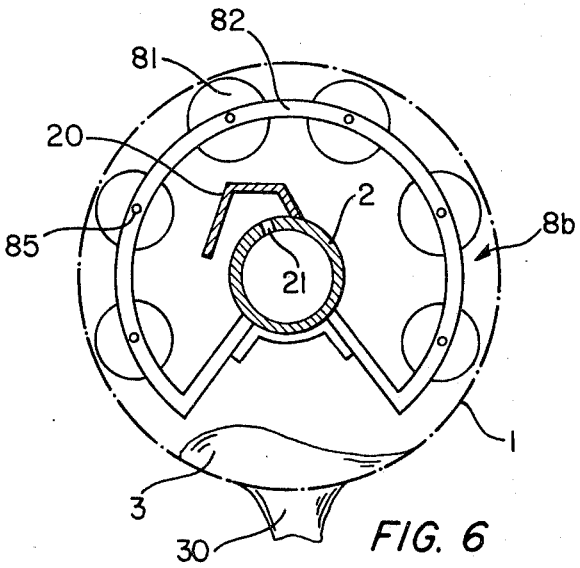
FIG. 6 is a transverse sectional view of a sixth apparatus.

FIG. 6 shows a further apparatus wherein the carrier 8*b* includes a set of rollers 81 each of which extends in parallelism with the axis and along the full length of the elongated screen 1 or each of which includes several discrete sections spaced apart from one another, as considered in the axial direction of the screen. The end portions of shafts 85 of the rollers 81 are journalled in two cages 82 (only one shown). There is no need to provide any squeegees or the like in the interior of the screen 1, i.e., the operation of this apparatus is analogous to that of the apparatus which is shown in FIG. 1, 2 or 5.

The carrier 8*b* can include or support a squeegee in the form of a doctor blade or the like. The same holds true for the carrier 8 of FIG. 5.

Figure 7:
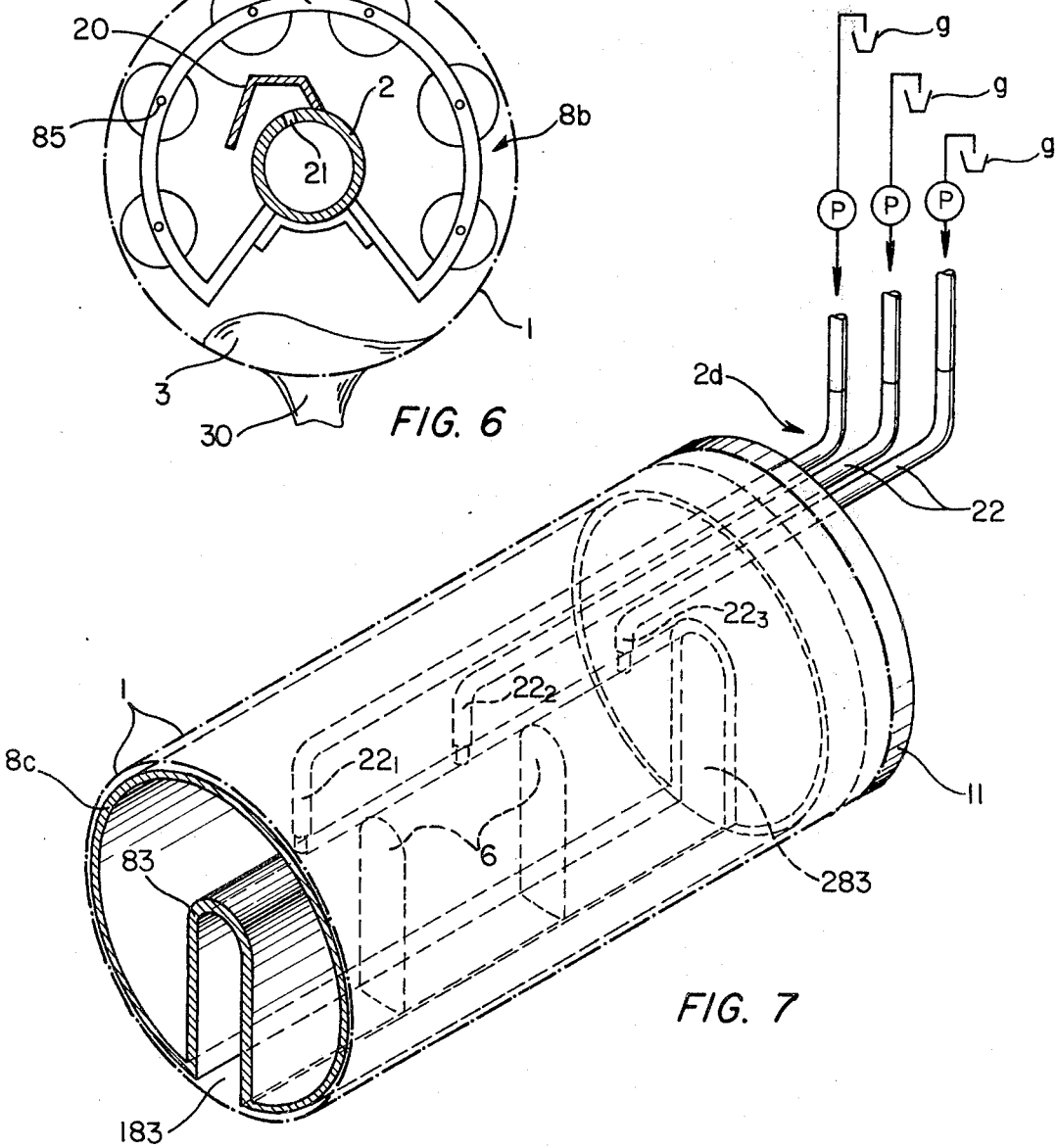
FIG. 7 is a fragmentary perspective view of a further apparatus.

Referring finally to FIG. 7, there is shown a screen printing apparatus wherein the interior of the screen 1 accommodates a carrier 8*c*. The latter is designed in such a way that a portion thereof can constitute an equivalent of a squeegee or an analogous applicator. The squeegee which is formed by a portion of the carrier 8*c* operates at normal pressure. To this end, the carrier 8*c* has an inverted U-shaped wall 83 which defines an elongated channel 183 extending in parallelism with the axis of the screen 1 and receiving ink from a feeding unit 2*d* having three hoses or pipes 22 each of which receives a supply of ink from a discrete source g via pump P. The channel 183 which is defined by the wall 83 of the carrier 8*c* can comprise or contain one, two or more transverse partitions 6 which subdivide the channel into several chambers each receiving ink from the discharge end of a different hose 22. The provision of partitions 6 is particularly desirable if the sources g contain different types of ink. The pumps P can supply ink into the channel 183 at an elevated pressure. The thus admitted ink then drips through the apertures of the screen 1 and onto the stock (not shown) therebelow. The operation is practically free of pressure since the squeegee is constituted by a portion (83) of the carrier 8*c*.

The two ends of the channel 183 are closed or sealed by end walls 283 (only one shown in FIG. 7). The discharge ends $22_1$, $22_2$, $22_3$ of the three hoses 22 are staggered, as considered in the axial direction of the screen 1, so that each thereof admits ink into a different chamber of the channel 183, namely, into the chamber between the two partitions 6, into the chamber between the right-hand partition 6 and the illustrated end wall 283, and into the chamber between the left-hand partition 6 and the other end wall. Each of the sources g can comprise or constitute a means for foaming the ink in the respective bath.

The channel 183 which is defined by the wall 83 of the carrier 8c can accommodate a slotted doctor blade or another form of a squeegee.

The invention is not limited to the embodiments which are shown in the drawing. An important feature of the invention is that the screen 1 is at least substantially free of pressure, namely, that the interior of the screen is not maintained at an elevated pressure. If a squeegee or the like (such as the doctor blade 7 or 70) is utilized, it should operate without pressure. The carrier or support (including the bolts 12 of FIG. 5) which maintains the highly sensitive screen 1 in the desired raised position at a selected distance a from the upper side of the stock can be designed in any one of a number of different ways. The arrangement is preferably such that only certain portions of the support engage and carry the screen not only lengthwise but also in the circumferential direction. Thus, the support can be assembled of several sections distributed lengthwise of the screen.

The term "stock" is intended to encompass a wide variety of commodities which can be treated in the apparatus or the present invention. It is intended to denote foils, paper sheets, webs or sheets consisting of a wide variety of textile materials including those which contain woven or non-woven filaments, products made of glass, ceramic material, metal, cork and/or others. It has been found that the improved apparatus is particularly suitable for the treatment of napped fabrics, for example, carpets, and such treatment can involve mere coloring and/or the application of relatively simple or highly intricate patterns.

An important advantage of the improved screen printing apparatus is that, depending on the consistency of the liquid medium or media which are admitted into the interior of the screen, the liquid can descend from the screen and onto the stock therebelow at any desired rate and without any interference all the way between the locus where it issues from the screen and the surface of the stock therebelow. The apparatus can be used with equal advantage for uniform coloring or coating of a running web or for the application of one or more patterns, depending on the size and/or distribution of pores in the screen. As the screen rotates or circulates, it entrains at least some of the liquid which forms the pool to thus produce (if necessary) a desirable blending effect by causing delayed descent of liquid onto the surface of the stock. Such liquid can produce streaks or similar effects.

For example, if the liquid in the interior of the screen is an ink, dripping of ink onto the stock can take place in such a way that only certain isolated areas of the surface of the stock receive droplets of ink, especially if the screen is driven at a relatively high speed and the number of open pores in the screen is relatively small. However, if the screen is driven at a low speed and its pores are large, or the number of pores in the screen is substantial, the apparatus can coat large areas of the upper side of the stock with one or more inks because the dimensions of the droplets are then large. It is also possible to increase the number and/or the size of pores at or close to one or both ends of the screen so that the apparatus provides a first pattern in the central region of the stock and one or two different patterns along one or both marginal portions of the stock.

It is also possible to select the number and distribution of open pores in the screen in such a way that the apparatus effects a more or less uniform coating or coloring of the entire stock but the rate of discharge of ink at selected locations of the screen is more pronounced than elsewhere so that, even though the stock is coated with a single type of ink, its surface nevertheless exhibits a pattern or image due to larger depositions of ink on selected areas than on the remaining areas of the stock. This can be said to entail a different shading of various portions of the finished product.

It is further within the purview of the invention to install two or more discrete screens one after the other, as considered in the direction of movement (arrow E) of the stock, and to use each screen for the application of a differently colored ink or for the application of a different pattern of ink on one and the same stock. The dimensions and/or other features of successive apparatus need not be identical, i.e., the axial length of a preceding screen need not necessarily match that of the next-following screen. Each of a series of two or more apparatus can apply a different ink or different chemicals, protective coatings, etc. Thus, the versatility of the improved apparatus (or of a combination of two or more such apparatus) is practically unlimited, not only as concerns the number of different liquid media which can be applied to one and the same stock but also as regards the distribution and the rate of application of one or more liquid media. The rate of application can be influenced by providing the apparatus with, or by using the apparatus without, one or more applicators in the form of rigid, elastic, slotted or unslotted squeegees or the like.

As used herein, the term "screen" is intended to denote all kinds of foraminous structures which are used in connection with screen printing and similar techniques for the passage of one or more liquid media through uniformly or otherwise distributed and/or dimensioned pores. The screen may constitute a self-supporting or deformable hollow cylinder, a band which is trained over several pulleys or the like, or any other configuration which is suitable for use in screen printing. The pores of the screen can be defined by wires, by filaments consisting of natural fibers, synthetic plastic or other material, by making holes in a galvanized sheet-like body, and so forth.

The liquid media which can be applied by resort to the improved apparatus can be foamed or free of bubbles, they may constitute simple inks or upgrading (refining) inks, cleaning fluids and/or others. Chemical pastes and other highly viscous liquids can be used to color, pickle or upgrade the stock. Latex foams or the like can be used with equal advantage. All that counts is that the liquid medium or media can descend from the screen across the distance a and come into contact with the stock at a desired rate and in desired regions.

The manner in which the screen 1 can be mounted for movement toward and away from the path for the stock (between an infinite number of positions) and in which the screen can be rotated at any one of a preferably infinite number of speeds is disclosed, for example, in commonly owned U.S. Pat. Nos. 3,965,816, 3,881,413 and 3,995,552 whose disclosures are incorporated herein by reference, together with the disclosures of all patents which are mentioned therein. Reference may also be had to other commonly owned United States Letters Patent. All that is necessary is to provide suitable means for changing the distance a by shifting the screen 1 and/or the means which defines the path for the stock, and to provide suitable means for rotating or otherwise moving the screen at any one of a number of different speeds.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A screen printing apparatus, comprising a circulating hollow porous screen; means defining a path for the stock to be treated at a level below and spaced apart from said screen; and means for feeding into the interior of said screen at least one liquid medium which forms therein a pool and passes through the pores of the screen to descend onto the stock in said path exclusively by gravity and without contacting any mechanical parts intermediate said screen and the stock in said path.

2. The apparatus of claim 1, further comprising carrier means for supporting said screen at a selected distance above said path.

3. The apparatus of claim 2, wherein said carrier means includes means for infinitely varying said distance.

4. The apparatus of claim 1, further comprising applicator means cooperating with and disposed in said screen to effect the passage of liquid medium through the pores of said screen.

5. The apparatus of claim 4, wherein said applicator means comprises a pressure-free squeegee.

6. The apparatus of claim 1, wherein said squeegee comprises a doctor blade.

7. The apparatus of claim 6, wherein said blade is slotted.

8. The apparatus of claim 1, further comprising carrier means for supporting said screen at a selected distance from said path, at least a portion of said carrier means being disposed in the interior of said screen.

9. The apparatus of claim 8, wherein said carrier means is stationary and provides room for the accumulation of said pool in the lower part of the interior of said screen.

10. The apparatus of claim 9, wherein said screen is elongated and said carrier means includes several sections spaced apart from one another, as considered in the longitudinal direction of said screen.

11. The apparatus of claim 8, further comprising applicator means supported by said carrier means and disposed in the interior of said screen.

12. The apparatus of claim 8, wherein said carrier means includes a portion disposed in the interior of said screen and constituting applicator means for effecting the flow of liquid medium from the pool through the pores of said screen.

13. The apparatus of claim 12, wherein said applicator means defines an elongated channel and the pool of admitted liquid medium accumulates in said channel.

14. The apparatus of claim 13, wherein said screen is at least substantially horizontal and said channel is disposed in the lower part of the interior of said screen.

15. The apparatus of claim 13, wherein said carrier means includes end walls closing the ends of said channel.

16. The apparatus of claim 1, further comprising at least one partition disposed in the interior of said screen and subdividing such interior into a plurality of compartments.

17. The apparatus of claim 1, wherein said screen is elongated and said feeding means has a plurality of outlet openings spaced apart from one another, as considered in the longitudinal direction of said screen.

18. The apparatus of claim 1, wherein said feeding means comprises at least one elongated pipe extending into and lengthwise of said screen.

19. The apparatus of claim 1, wherein said feeding means constitutes a carrier supporting said screen at a selected distance from said path.

20. The apparatus of claim 1, wherein said feeding means includes carrier means supporting said screen at a selected distance from and above said path.

21. The apparatus of claim 1, wherein said screen is elongated and further comprising carrier means for said feeding means and means for oscillating said feeding means through the medium of said carrier means.

22. The apparatus of claim 21, further comprising at least one partition disposed in the interior of said screen and supported by said carrier means, said oscillating means being operative to move the feeding means and the partition back and forth in the longitudinal direction of said screen.

23. The apparatus of claim 1, further comprising at least one applicator provided in and subdividing the interior of said screen into a plurality of compartments.

24. The apparatus of claim 23, wherein said screen is elongated and further comprising means for moving said applicator back and forth in the longitudinal direction of said screen.

25. The apparatus of claim 1, wherein said feeding means includes several discrete feeding elements.

26. The apparatus of claim 25, further comprising a common source of liquid medium for all of said feeding elements.

27. The apparatus of claim 25, further comprising discrete sources of different liquid media for said feeding elements.

28. The apparatus of claim 1, wherein said screen has at least one pattern of pores.

29. The apparatus of claim 1, wherein said screen has uniformly distributed pores.

30. The apparatus of claim 1, further comprising means for moving said screen at any one of an infinite number of different speeds.

* * * * *